US005837371A

United States Patent [19]

Rivas

[11] Patent Number: 5,837,371

[45] Date of Patent: Nov. 17, 1998

[54] ACRYLIC YARN DYEING AND LUBRICATION PROCESS

[75] Inventor: Dominick J. Rivas, Newport, N.C.

[73] Assignee: Amital Spinning Corporation, New Bern, N.C.

[21] Appl. No.: 826,024

[22] Filed: Mar. 28, 1997

[51] Int. Cl.[6] ..... B32B 27/00; D02G 3/00

[52] U.S. Cl. ..... 428/394; 8/115.54; 8/495; 252/8.84; 427/389.9; 428/484; 508/450

[58] Field of Search ..... 8/115.54, 495; 252/8.84; 427/389.9; 428/394, 484; 508/450

[56] References Cited

U.S. PATENT DOCUMENTS

| | | | |
|---|---|---|---|
| 3,519,562 | 7/1970 | Lanner | 252/8.8 |
| 3,773,463 | 11/1973 | Cohen et al. | 252/8.8 |
| 3,821,136 | 6/1974 | Hudgin et al. | 260/9 |
| 4,046,505 | 9/1977 | Cobb et al. | 8/18 R |
| 4,097,232 | 6/1978 | Negola et al. | 8/65 |
| 4,201,680 | 5/1980 | Waltenberger | 8/115.6 |
| 4,252,528 | 2/1981 | Decker et al. | 8/115.6 |
| 4,583,987 | 4/1986 | Kurz | 252/8.81 X |
| 5,165,993 | 11/1992 | van Anholt | 428/364 |
| 5,282,871 | 2/1994 | Yamane et al. | 252/8.84 |
| 5,387,263 | 2/1995 | Marlowe et al. | 252/8.84 X |
| 5,389,136 | 2/1995 | Danner | 252/8.63 X |

*Primary Examiner*—Michael Lusignan
*Attorney, Agent, or Firm*—Rhodes, Coats & Bennett, L.L.P.

[57] ABSTRACT

A process for lubricating acrylic fibers before dyeing in which packages of acrylic yarn formed by winding acrylic yarn about a dye tube are treated immersed in an aqueous lubricating bath containing a polyethylene, a low melting paraffin wax emulsion; and a high melting paraffin wax emulsion, followed by raising the temperature of the bath, to sequentially coat the fibers of the yarn with the polyethylene, the low melting paraffin wax emulsion, and the high melting paraffin wax emulsion. The yarn packages are then separated from the lubricating bath, and immersed in a dye bath to dye the yarn. In commercial application, the lubrication and subsequent dyeing is conducted in the chamber of a dye machine.

18 Claims, 1 Drawing Sheet

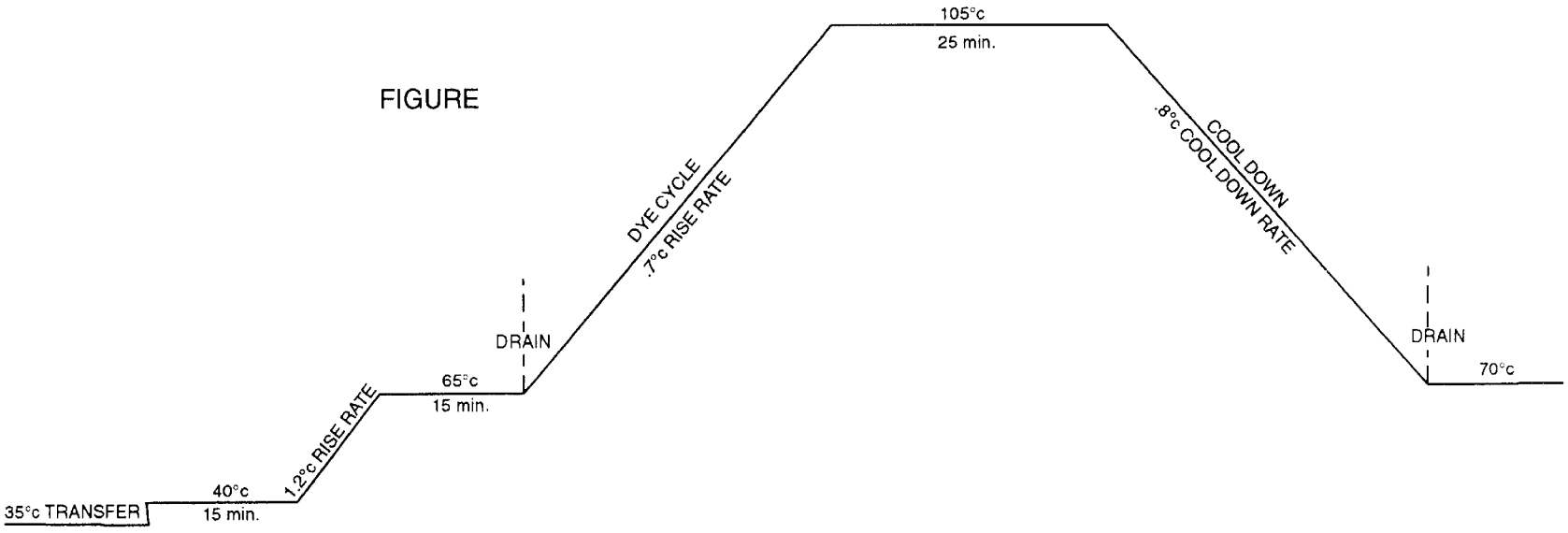
FIGURE

ACRYLIC YARN DYEING AND LUBRICATION PROCESS

BACKGROUND OF THE INVENTION (1) Field of the Invention

The present invention relates generally to a process and composition for lubricating yarn to reduce yarn to metal friction, and in particular to a process and composition for lubricating the fibers of acrylic yarn prior to dyeing, thereby eliminating the necessity of rewinding.

(2) Description of the Prior Art

Conventionally, synthetic yarn, wound onto dye springs or tubes to form yarn packages, is dyed by placing a plurality of yarn packages onto a perforated spindle in a package dyeing machine, and immersing the yarn packages into a dye bath under predetermined time and temperature conditions. The dye bath solution is normally pumped through the yarn package from, and then into, the perforated spindle to ensure uniform dyeing.

After dyeing, the yarn is wound onto a paper tube for shipment to the user. During rewinding, a lubricant is applied to the yarn to reduce the yarn's fiber to metal friction. Otherwise, the yarn would break during use, as well as causing needle breakage, and holes in fabrics produced. Since the cost of rewinding increases the total cost of yarn manufacture, it would be desirable if this added step could be eliminated.

Various attempts have been made in the prior art to eliminate rewinding, allowing direct use of the yarn package coming from the dye bath, and thereby reducing the cost of the product. For example, U.S. Pat. No. 3,773,463 to Cohen et al describes a process for dyeing polyacrylonitrile and cationic dyeable polyester fibers and yarns in the presence of an agent that operates as a leveling, lubricating and antistatic agent. The agent is comprised of an aqueous blend of 30–80 parts of a quaternary ammonium compound and 20–70 parts of a polyoxyethylene compound. The bath containing the agent, the dye and the fiber is heated to the dyeing temperature, e.g., 212° F., and held at that temperature for a period of time, e.g., 40 minutes. The fiber is then rinsed.

U.S. Pat. No. 4,583,987 to Kurz also describes a process for lubricating yarns at the same time as dyeing. The lubricating composition is comprised of silicone oil and a wax, e.g., paraffin wax. The composition can also contain other components that act as emulsifiers, stabilizers, softeners, etc. The yarn is first treated at about 40° C. for 5 minutes, and the temperature is then raised to 130°–135° C., where the yarn is dyed for 30–60 minutes.

U.S. Pat. No. 5,282,871 to Yamane et al describes a spinning lubricant for acrylic fibers comprised of at least one wax having a melting point of 30°–130° C., and at least one cationic or amphoteric surfactant. The wax may be a paraffin wax, or a polyethylene wax. An aqueous emulsion of 1–10% of the composition is used.

U.S. Pat. No. 5,387,263 to Marlowe et al describes a process for lubricating yarn in which the yarn is first dyed, and then lubricated with a composition applied to the dye bath, or to the dyeing machine after draining of the dye bath. The lubricant is a paraffin wax, containing an emulsifier and an antistat. A mineral oil can also be used.

While the above patents teach that it is generally known to treat yarn with a lubricant during or after dyeing, there has heretofore been no available process whereby an acrylic yarn could be lubricated prior to dyeing.

SUMMARY OF THE INVENTION

The present invention is directed to a process and composition for lubricating synthetic yarn before dyeing of the yarn, preferably in a package dyeing machine. The process comprises placing packages of synthetic yarn in an aqueous bath of a defined lubricating composition to effect coating of the yarn with the lubricant, separating the yarn from the lubricating bath, and then placing the yarn in a dye bath to effect dyeing. More specifically, the present invention is directed to a process and formulation for lubricating acrylic yarn in a package dyeing machine before dyeing of the yarn in the machine.

In order to achieve the objectives of the invention, it is necessary to uniformly coat the surface of the yarn fibers with an abrasion resistant coating, while still leaving dye sites exposed for subsequent lubrication. Penetration of the lubricating material into the fiber must be avoided, as must clumping of fibers together with the lubricant. At the same time, the lubricant must adhere firmly to the fiber.

Surprisingly, it has been found that the desired results can be achieved using an aqueous lubricating composition containing three essential ingredients, that are applied to the fibers in sequence to form a multi-layer coating on the yarn fibers. These essential components are 1) a polyethylene; 2) a low melting paraffin wax having a melting point of less than 70° C., preferably between 60° C. and 68° C.; and 3) a higher melting paraffin wax having a melting point of between 70° C. and 115° C. The wax emulsions can be formed by using a conventional emulsifier, such as an alkylethoxylated tallowamine. Preferably, the three ingredients are in the form of water dilutable emulsions. The polyethylene is preferably a polyethylene or polyethylene oxide wax emulsion having a melting point of less than about 130° C., and preferably from about 30° C. to about 100° C.

For most applications, the ratio of low melting paraffin wax to high melting paraffin wax will be in the range of about 1:2 to 2:1. The ratio of polyethylene to low melting paraffin wax will be in the range of from about 1:1 to 1:5. It should be understood, however, that amounts in excess of these ratios may be present in the bath, but some wastage may result.

Other ingredients may also be used in the lubricant composition. These optional ingredients include antistats, softeners, biocides, defoamers, and sequestering agents. The pH of the composition may be adjusted with a pH adjuster, such as acetic acid or sodium acetate.

The desired dye permeable coating of the fibers is achieved in three stages, determined by the bath temperature. First, the polyethylene is bonded to the fibers. The bath temperature is then raised to the next level to effect bonding of the low melting paraffin wax onto the polyethylene. Finally, the high melting paraffin wax is bonded onto the surface of the low melting paraffin wax to form a hard, abrasion resistant surface on the fibers, that is still sufficiently permeable to permit dyeing of the underlying fibers.

The essential ingredients, and any optional ingredients, may be added individually to the yarn treatment bath. Normally, however, at least the essential ingredients, and preferably all ingredients of the lubricant composition, are prepared as a concentrate, which is added to the bath. Preferably, the concentrate composition is comprised of the following ingredients in the percentages specified:

| Ingredient | % by Wt. |
|---|---|
| Polyethylene | 4–7 |
| Paraffin wax emulsion (low melting) | 10–20 |
| Paraffin wax emulsion (high melting) | 10–20 |
| Antistat | 0–3 |
| Softener | 0–1 |
| pH Adjuster | 0.01–0.06 |
| Sequestering Agent | 0–0.1 |

The pH of the lubricant bath should be in the range of from about 5.5 to about 6.1 to prevent particles of the lubricant material from bonding between fibers inside of the package. Acetic acid will normally be used as the pH adjuster. Other pH adjusters can be used instead.

When used, the above composition is mixed in the lubrication bath with water in an amount based upon the weight of the yarn to be lubricated. Generally, the concentrate will be diluted until the composition, excluding water, is equal to from about 3 to about 5% by weight of the lubricating bath. It will be understood, however, that greater amounts can be used. However, these amounts are generally sufficient to lubricate the yarn in a normal bath. Normally, the amount of the essential ingredients, expressed as a percentage of the weight of yarn being lubricated, will be from about 0.12 to about 0.35 weight % polyethylene, from about 0.3 to about 1.0 weight % low melting paraffin wax, and from about 0.3 to about 1.0 weight % high melting paraffin wax.

In practicing the process, yarn packages, comprised of yarn wound onto a core or dye spring, are positioned onto a perforated spindle in a known manner, and the spindle is placed into the treatment chamber or tank of a package dye machine. The chamber is the filled with lubricant, and the bath is then heated as the aqueous lubricant bath is first pumped outwardly from the interior of the spindle through the yarn packages, and then inwardly through the packages. The temperature of the bath is first increased to a level whereat the polyethylene bonds to the yarn fibers. After bonding of the polyethylene coating, the bath temperature is then raised to a temperature where the lower melting paraffin wax emulsion coats the polyethylene. Finally, the temperature is raised to a level where the higher melting temperature paraffin wax adheres to the lower melting paraffin wax, forming an outer lubricating surface on the exterior of the yarn.

The bath temperature at the start of the process will normally be at room temperature, and should be less than 35° C. At a first temperature level of about 35° C., the polyethylene bonds to the outer surface of the fibers. At a second temperature level of about 40° C., the low heat paraffin wax will bond over the top of the polyethylene and distribute evenly. As the bath temperature is further raised to a third temperature level of about 65° C., the high heat paraffin wax swells and bonds over the low paraffin wax, creating a lubricating surface that reduces the friction of the fiber, while still allowing the dye sites of the fiber to evenly accept dye.

Normally, the bath temperature will be held at the second and third temperature levels for a short period of time, e.g., up to about 5–20 minutes, to permit the low or high melting paraffin, depending upon the temperature level, to distribute evenly. It should be understood, however, that the exact temperatures at which each layer is imparted to the fiber may vary depending upon various conditions, and that the process in a continuous process, whereby the treatment bath is raised from a temperature of below about 35° C. to about 65° C. to effect the multi-layer coating of the fibers.

After treatment of the fibers in the lubricating bath, the dye machine chamber is drained, and the lubricant bath is replaced with a conventional dye bath. The composition of the dye bath and the parameters of the dyeing process are not critical elements of the invention. The dye bath temperature is raised to the dyeing temperature applicable to the particular dye, e.g., about 105° C. and the temperature is maintained for a time sufficient to effect the desired dyeing, e.g., about 25 minutes. The dye bath is then cooled to about 70° C., and drained.

Accordingly, one aspect of the invention is to provide a process for lubricating synthetic yarn prior to dyeing comprising immersing the yarn in an aqueous bath containing a polyethylene or polyethylene oxide emulsion, a low melting paraffin wax emulsion; and a high melting paraffin wax emulsion; and raising the temperature of the bath, whereby the polyethylene coats the fibers, followed by the low melting paraffin wax emulsion coating the fibers, and finally by the high melting paraffin wax emulsion coating the fibers.

Another aspect of the present invention is to provide a lubricant composition for use in lubricating synthetic yarn in an aqueous bath comprising polyethylene, a low melting paraffin wax emulsion; and a high melting paraffin wax emulsion.

Still another aspect of the present invention is to provide a process for sequentially lubricating and dyeing the fibers of packages of acrylic yarn formed by winding acrylic yarn about a dye tube comprising immersing the yarn packages in an aqueous bath containing a polyethylene, a low melting paraffin wax emulsion; and a high melting paraffin wax emulsion; raising the temperature of the bath, whereby the polyethylene, low melting paraffin wax emulsion, and high melting paraffin wax emulsion sequentially coat the fibers; separating the packages from the bath; placing the yarn packages in an aqueous bath containing a dye; and dyeing the fibers.

These and other aspects of the present invention will become apparent to those skilled in the art after a reading of the following description of the preferred embodiment.

BRIEF DESCRIPTION OF THE DRAWING

The drawing is a diagrammatic illustration of the temperature and time stages used in one example of the invention.

EXAMPLE

Open end acrylic yarn packages weighing 4.7 lbs. on Diaflex tubes were loaded into a dye machine, and the machine wall filled with a treating solution containing polyethylene, low melting paraffin wax, and high melting paraffin wax, along with an emulsifier. The pH of the bath was adjusted to the range of 5.5 to 6.10.

The bath, having a start-up temperature of 30° C., was pumped through the yarn packages at the rate of 3.5 gallons of bath per pound of yarn per minute, while the temperature of the bath was then raised in stages as illustrated in the drawing. At 35° C., the fibers were coated with the polyethylene. The bath temperature was then raised to 40° C., and held at that temperature for 15 minutes to allow the low melting paraffin wax to uniformly coat the polyethylene. The bath temperature was then raised at the rate of 1.2° C. per minute to 65° C., and held at this temperature for an additional 15 minutes, to allow the high melting paraffin wax to form a hard coating over the low melting paraffin wax.

The dye machine was then drained and filled with the dye bath. The temperature of the dye bath was then raised to 105° C., and held for 25 minutes to complete the dyeing process. The bath was then cooled to 70° C., drained, and the yarn packages were dried. The fiber to metal friction of the yarn was then tested with a Lawson Hemphill friction meter, known in the industry, which displays a numerical value indicating the frictional resistance to a fiber drawn over a metal surface. The yarn was found to have a reading on the Lawson Hemphill meter of below 0.14. To the contrary, yarns treated under similar conditions, but with the polyethylene or paraffin wax eliminated from the treatment bath, when knitted into fabrics, broke, causing runs and holes in the fabric.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A process for lubricating synthetic yarn prior to dyeing comprising:

a) immersing said yarn in an aqueous bath containing effective lubricating amounts of a polyethylene wax, a first paraffin wax having a melting point of less than 70° C., and a second paraffin wax having a melting point of from about 70° C. to about 115° C.; and b) raising the temperature of said bath, whereby said polyethylene wax coats said fibers, followed by said first paraffin wax coating said fibers over said polyethylene wax, and finally by said second paraffin wax coating said fibers over said first paraffin wax.

2. The process of claim 1, wherein said yarn is in the form of a yarn package formed by winding said yarn fibers around a dye tube.

3. The process of claim 1, wherein said polyethylene wax is selected from the group consisting of polyethylene wax emulsions and polyethylene oxide wax emulsions.

4. The process of claim 1, wherein said lubricating bath further includes at least one additional ingredient selected from the group consisting of antistats, softeners and sequestering agents.

5. The process of claim 1, further including the steps of separating said yarn from said lubricating bath, and immersing said yarn in a dye bath.

6. The process of claim 1, wherein said bath temperature is raised to about 35° C. to coat said fibers with said polyethylene wax, then to about 40° C. to coat said fibers with said first paraffin wax, and to about 65° C. to coat said fibers with said second paraffin wax.

7. The process of claim 1, wherein said lubricating bath includes, based upon the weight of yarn being lubricated, from about 0.12 to about 0.35 weight % polyethylene wax, from about 0.30 to about 1.0 weight % of said first paraffin wax, and from about 0.30 to about 1.0 weight % of said second paraffin wax.

8. The process of claim 1, wherein the polyethylene wax and said first paraffin wax are present in the lubricating bath in a ratio of from about 1:1 to about 1:5.

9. The process of claim 1, wherein said first paraffin wax and said second paraffin wax are present in the lubricating bath in a ratio of from about 1:2 to about 2:1.

10. A lubricant composition for use in lubricating synthetic yarn in an aqueous bath comprising effective lubricating amounts of a polyethylene wax, a first paraffin wax emulsion having a melting point of less than 70° C., and a second paraffin wax emulsion having a melting point of from about 70° C. to about 115° C.

11. The composition of claim 10, wherein said polyethylene wax is selected from the group consisting of polyethylene wax emulsions and polyethylene oxide wax emulsions.

12. The composition of claim 10, wherein the polyethylene wax and said first paraffin wax emulsion are present in the lubricating bath in a ratio of from about 1:1 to about 1:5.

13. The composition of claim 10, wherein said first paraffin wax emulsion and said second paraffin wax emulsion are present in the lubricating bath in a ratio of from about 1:2 to about 2:1.

14. The composition of claim 10, wherein said lubricating bath further includes at least one additional ingredient selected from the group consisting of antistats, softeners and sequestering agents.

15. A synthetic fiber with a multi-layer lubricating coating thereon comprised of:

a) a first layer of polyethylene wax adjacent said fiber;

b) a second layer of a first paraffin wax over said polyethylene wax layer, said first paraffin wax having a melting point of less than 70° C.; and c) a third layer of a second paraffin wax over said first paraffin wax, said second paraffin wax having a melting point of from about 70° C. to about 115° C.

16. The fiber of claim 15, wherein said polyethylene wax is selected from the group consisting of polyethylene and polyethylene oxide waxes.

17. The fiber of claim 15, wherein said synthetic fiber is an acrylic fiber.

18. The fiber of claim 15 wherein said fiber is undyed.

* * * * *